US005108096A

United States Patent [19]

Ponce

[11] Patent Number: 5,108,096

[45] Date of Patent: Apr. 28, 1992

[54] PORTABLE ISOTONIC EXERCISER

[76] Inventor: Luis Ponce, 185 Matilda Ct., Morgan Hill, Calif. 95037

[21] Appl. No.: 586,664

[22] Filed: Sep. 24, 1990

[51] Int. Cl.[5] ..... A63B 21/02

[52] U.S. Cl. ..... 482/125; 482/126

[58] Field of Search ..... 272/93, 125, 126, 135, 272/137-139, 143; 24/18, 128, 713, 129 R

[56] References Cited

U.S. PATENT DOCUMENTS

| | | | |
|---|---|---|---|
| 122,135 | 12/1871 | Setchell | 24/129 R |
| 1,407,406 | 2/1922 | Glazebrook | 24/129 R |
| 2,280,274 | 4/1942 | Wildermuth | 272/126 |
| 2,467,943 | 4/1949 | Mikell | 272/134 |
| 3,119,614 | 1/1964 | Berry | 272/125 |
| 3,204,955 | 9/1965 | Quiso | 272/125 |
| 3,631,570 | 1/1972 | Coleman | 272/129 R |
| 3,910,573 | 10/1975 | Jamba | 272/125 |
| 4,090,706 | 5/1978 | Reda | 272/143 |
| 4,105,349 | 8/1978 | Kupperman et al. | 24/129 R |
| 4,456,249 | 6/1984 | Calabrese | 272/126 |
| 4,463,948 | 8/1984 | Mohr | 272/137 |
| 4,570,921 | 2/1986 | Arnold | 272/137 |
| 4,609,191 | 9/1986 | Remmo | 272/137 |
| 4,728,103 | 3/1988 | Fulton | 272/137 |
| 4,733,862 | 3/1988 | Miller | 272/137 |
| 4,815,731 | 3/1989 | Suarez | 272/137 |
| 4,909,566 | 3/1990 | Smith | 272/139 |

*Primary Examiner*—Robert Bahr
*Assistant Examiner*—J. Donnelly
*Attorney, Agent, or Firm*—Davis & Schroeder

[57] ABSTRACT

A self-contained exerciser provides eccentric, concentric and isometric, as well as vertical and horizontal exercise for nearly all muscles of the human body. The exerciser includes body pads and handles joined together with latex surgical tubing which is secured by a removable knot at each end of the tubing utilizing a knotting clip. The exerciser is adjustable by relocation of the body pads and handles along the length of the tubing. The knotting clip allows for easy tying and untying of the securing knots and their relocation along the length of the tubing.

11 Claims, 4 Drawing Sheets

PORTABLE ISOTONIC EXERCISER

BACKGROUND OF THE INVENTION

This invention relates to exercise equipment, more particularly self-contained exercisers for individual use that do not require special facilities, anchoring or the like. The present invention is compact, light-weight and portable, thus convenient for everyday use, even while traveling.

There are three forms of exercise utilizing forces to exercise the muscles of the body, namely, 1) eccentric forces, wherein the muscles move an object away from the body; 2) concentric forces, wherein an object is moved toward the body; and 3) isometric forces, wherein the muscles exert force against a static object. Utilizing these three types of exercise, nearly all the muscles of the body can be toned and conditioned. It is desireable to provide an exerciser which utilizes all three forces to exercise muscles in both extension and contraction movements.

The numerous forms of exercise devices in the art utilize weights or springs as the basis for generating exercise forces. One of the best means, however, for generating force to exercise various parts of the human body is to employ elastic materials, such as latex surgical rubber tubing, to closely simulate the manner in which tendons, ligaments and muscles stretch and contract. This medium, however, presents some difficulties in forming knots which can be easily removed or retied and heretofore has not been successfully utilized in adjustable exercisers.

Elastic materials assume a smaller cross sectional area when they are elongated. This causes them to slip into tightly formed bends and knots which are difficult to untie when the material resumes its normal relaxed cross sectional dimension. This condition is useful for securely holding a knot when there is no intention to untie the knot but undesirable when the knot must be repositioned. One means to deal with repositioning the knot is to utilize a knotting device to control the spacing of the tightened loops in the knot in order to prevent over tightening of the knot.

U.S. Pat. No. 3,409,014 issued Nov. 5, 1968 to S. G. Shannon utilizes a knotting device to provide secure and speedy ligation during surgical procedures. In Shannon, a three-point knotting clip can be used to secure some materials, and a four-point clip is preferred for other materials. The three-point device disclosed by Shannon is utilized on materials which retain their original cross section when tightened, and the four-point device is utilized for materials which change their cross section when tightened. Shannon describes how the resilient forces of the ligated tissue maintain pressure on the knot to hold it secure, but neither discloses nor suggests how untying the resulting knots is facilitated.

U.S. Pat. No. 4,105,349 issued to Kupperman et al. discloses a knotting clip for tying knots in rope and the like for use in circumstances where a loop is desirable and the knot must be untied without difficulty. The clip disclosed by Kupperman et al. utilizes a reinforced border for strength and pointed projections to prevent slippage of the rope. In use, the rope is securely held against the pointed projections by a loop formed in the rope, whereby slippage is prevented by the projections protruding into and distorting the rope. Kupperman et al. neither suggests nor discloses how the clip could be utilized with elastomeric materials, such as latex rubber tubing, without damage to the material.

SUMMARY OF THE INVENTION

The present invention utilizes padded handles and wide, cushion-like body pads joined together with elastic tubing to form a portable, self-contained exercise device. The padded handles and body pads of the present invention are intended to be interchangeable, depending on the nature of the exercise.

The padded handles and body pads provide comfort for the user and diffuse the forces exerted on the hands and other body parts during the exercise. The wide body pads also allow the device to be comfortably anchored by opposing portions of the body so that no fixed or external anchor is required. Thus, the exerciser is completely portable.

The elastic tubing is secured to the handles and body pads by use of adjustable knots formed with the aid of a knotting clip which uses the cross-sectional change of elastic tubing to facilitate both tying and untying the knots. The length of each piece of elastic tubing is adjustable by positioning the knots so as to variably fix the position of the handles and pads relative to each other. By selection of elastic tubing length and weight (i.e. inside and outside diameters), the degree of force necessary to perform various exercises may be easily adjusted by the user.

In use, the exerciser is stretched longitudinally and returned slowly to its original length. By varying the anchoring point and the stretching limb, the exerciser of the present invention provides eccentric, concentric and isometric, as well as vertical and horizontal exercise for nearly all muscles of the human body. The slow stretching movement and resistive slow return provides a wide range of natural movement suitable for warm-up, as well as light and heavy exercise regimes, and cool-down thereafter.

DESCRIPTION OF THE DRAWING

For fuller understanding of the present invention, reference is made to the accompanying drawing in the following detailed Description of the Preferred Embodiment of the invention. In the drawing.

Figure 1:
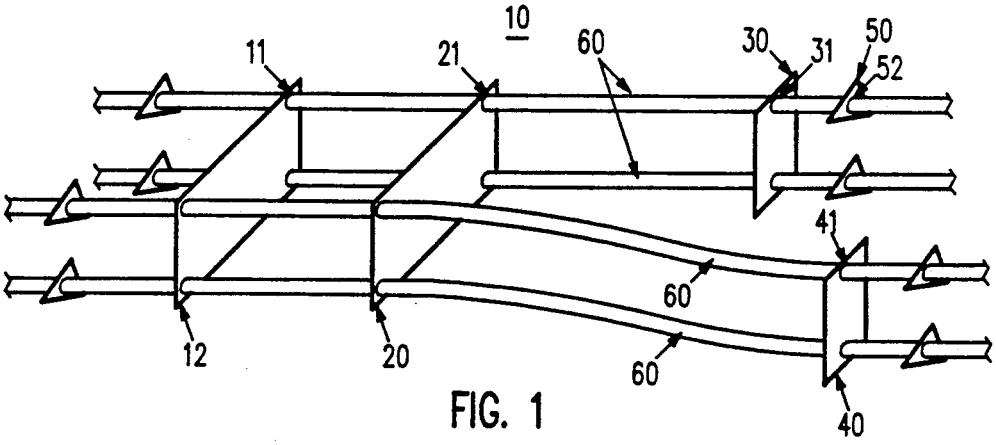
FIG. 1 is a perspective view of a fully assembled exerciser according to the present invention.

Reference numbers refer to the same or equivalent parts of the present invention throughout the several figures of the drawing.

DETAILED DESCRIPTION OF THE PREFERRED EMBODIMENT

Referring now to FIG. 1, exerciser 10 according to the present invention is shown. The preferred exerciser is assembled with cushioned body pads 12 and 20 and handles 30 and 40, body pads 12 and 20 each having apertures proximal each corner as represented by apertures 11 and 21 respectively. It should be noted that handles 30 and 40 are merely smaller configurations of body pads 12 and 20. For simplicity of discussion, apertures 11 and 21 are understood to represent each of the corresponding apertures proximal to the corners of body pads 12 and 20. Handles 30 and 40 each include apertures proximal each end as represented by apertures 31 and 41, respectively, are shown. Also for simplicity of discussion, apertures 31 and 41 are understood to represent each of the corresponding apertures in handles 30 and 40.

Body pads 12 and 20 and handles 30 and 40 are typically cushioned to provide comfort to the user during exercise by diffusing forces on the body parts. However, these pads may be formed of unpadded materials as well.

The use of body pads 12 and 20 and handles 30 and 40 is intended to be interchangeable, depending of the nature of the exercise. Thus, body pads 12 and 20 can be used as handles, and handles 30 and 40 can be used as body pads.

Four identical flexible members are indicated by flexible member 60. For simplicity of description in the following discussion reference to flexible member 60 is intended to describe the nature and function of each of the four flexible members. Flexible member 60 is typically made of latex surgical rubber tubing but any similarly resilient material may be utilized. Flexible member 60 may be of any convenient diameter, typically from one fourth to three fourths inch, with smaller tubing serving for less strenuous exercise, and larger diameter tubing, having greater tensile resistance for more strenuous exercise.

Flexible member 60 is threaded longitudinally through apertures 11, 21, 31 and 52 as illustrated. Each of the remaining flexible members are similarly threaded longitudinally through corresponding apertures in body pads 12 and 20, handles 30 and 40, and knotting clips 50.

To complete the assembly, each end of flexible member 60 is formed into a knot using knotting clip 50 as described hereinbelow. The formation of a knot prevents flexible member 60 from passing through apertures 11 and 31 and holds the assembled exerciser together when in use. The position of the knot relative to the end of flexible member may be varied as desired so as to shorten or lengthen the distance between the knots, thereby adjusting the tension and exercise extension as described hereinbelow.

Apertures 11, 21, 31 and 41 are of a size approximate to the diameter of flexible member 60 so as to allow easy passage of flexible member 60 therethrough. Apertures 11, 21, 31 and 41 should be smoothly formed so as to not abrade flexible member 60. Therefore, apertures 11, 21, 31 and 41 typically include grommets or other similar devices, of either metal or plastic material. However, aperture 11, 21, 31 and 41 also may be formed of sewn round openings in the manner of open buttonholes.

Figure 2:
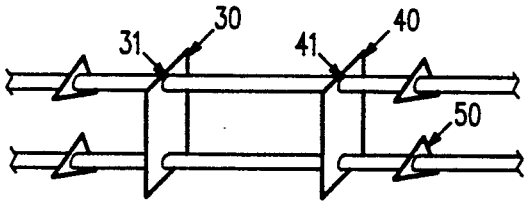
FIG. 2 is a perspective view of an assembled abbreviated exerciser.

Referring now to FIG. 2, an abbreviated exerciser is shown. Handles 30 and 40 are as described hereinabove. Flexible member 60 is threaded through aperture 31 in handle 30 and aperture 41 in handle 40. Each end of flexible member 60 is formed into a knot as described hereinbelow, securing the flexible member as described hereinabove. The two flexible members are adjusted to the same length and work in unison to provide maximum resistance to the movement and thereby the maximum exercise.

Figure 3:
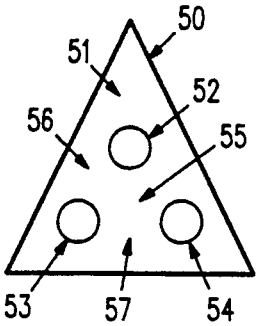
FIG. 3 is a top plan view of a knotting clip.
Figure 4:
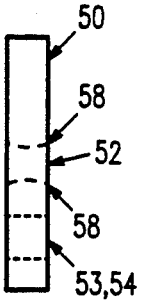
FIG. 4 is a side view of a knotting clip.

Referring now to FIGS. 3 and 4, a knotting clip is shown. Knotting clip 50 may be of any external shape, having front and rear faces 51. A triangular shape as illustrated or a circular shape are preferred for simplicity of construction. Knotting clip 50 is formed from flat rigid material, typically high-strength plastic but metal may also be utilized if desired. All edges are smoothly finished so as to prevent abrasion of the other components and for user safety.

Knotting clip 50 is formed with three apertures therethrough. Aperture 52 is proximal the center of knotting clip 50 and apertures 53 and 54 are near the periphery. The location of apertures 52, 53 and 54 forms an isosceles triangle with aperture 52 at the peak. Aperture 52 is at or near the center of the clip so that stresses exerted on the clip during use are approximately evenly distributed across the clip. This allows the use of unreinforced materials to form the clip. Each aperture 52, 53 and 54 is sized to closely approximate the diameter of flexible member 60 so as to allow insertion of flexible member 60 therethrough. Apertures 52, 53 and 54 each have full radius 58, as shown for example in FIG. 4 for aperture 52.

Spaces 55 and 56 between the apertures are sized to closely approximate two-thirds the diameter of flexible member 60. Spaces 55, 56 should not be in excess of three-fourths the diameter of flexible member 60 for proper functioning of knotting clip 50. Space 57 should be greater, typically one and one-half times the diameter of flexible member 60.

Figure 5:
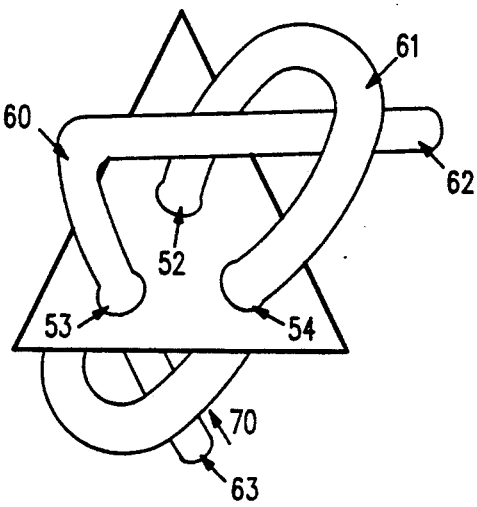
FIG. 5 is an illustration of the knotting clip with a flexible member forming a knot.

Referring now to FIG. 5, the forming of a knot in flexible member 60 utilizing knotting clip 50 is illustrated. Flexible member 60 is threaded from the reverse side of knotting clip 50 through aperture 52 and down through aperture 54, forming bend 61. Flexible member 60 is then threaded up through aperture 53 and end 62 is passed between bend 61 and front face 51 of knotting clip 50. End 62 should extend a minimum of one inch past bend 61 to assure security of the resulting knot. The resulting knot need not be tightly formed to knotting clip 50 front face 51. When operative end 63 of flexible member 60 is extended by usage of the exerciser, bend 61 tightens and is securely held from slippage by end 62 and the frictional forces exerted by flexible member 60 bending around knotting clip 50 after passing through apertures 52, 53, 54. The stress exerted on the knot by operating portion 63 during usage of the exerciser compresses end 62. When the stress is relieved end 62 expands to its normal cross-section and compresses flexible member 60 at the point where it passes through aperture 52, exerting sufficient force to retain flexible member 60 in position.

To untie the knot for repositioning, operating portion 63 is longitudinally moved in direction 70 through aperture 52 of knotting clip 50 to increase the size of bend 61 and allow end 62 to be removed. Knotting clip 50 is then repositioned as desired and the knot is reformed as described hereinabove.

Exerciser 10 configured as illustrated in FIG. 1 may be used for exercising many torso muscles. An anchor is formed by placing body pad 12 against the body and maintained by the tension created by grasping a handle in each hand and displacing each handle away from the body during an exercise routine. By varying the selection of the anchoring point and the extending direction and limb, various muscles in the body may be exercised including muscles in the legs, arms, shoulders and torso as discussed hereinbelow.

An exerciser configured as illustrated in FIG. 2 may be used for exercising arms and upper torso muscles by grasping a handle in each hand and displacing one handle away from the other. Similarly, anchoring one handle with one limb while displacing the other handle with another limb can exercise various muscles in the arms, chest, legs and lower torso as discussed hereinbelow.

Figure 6B:
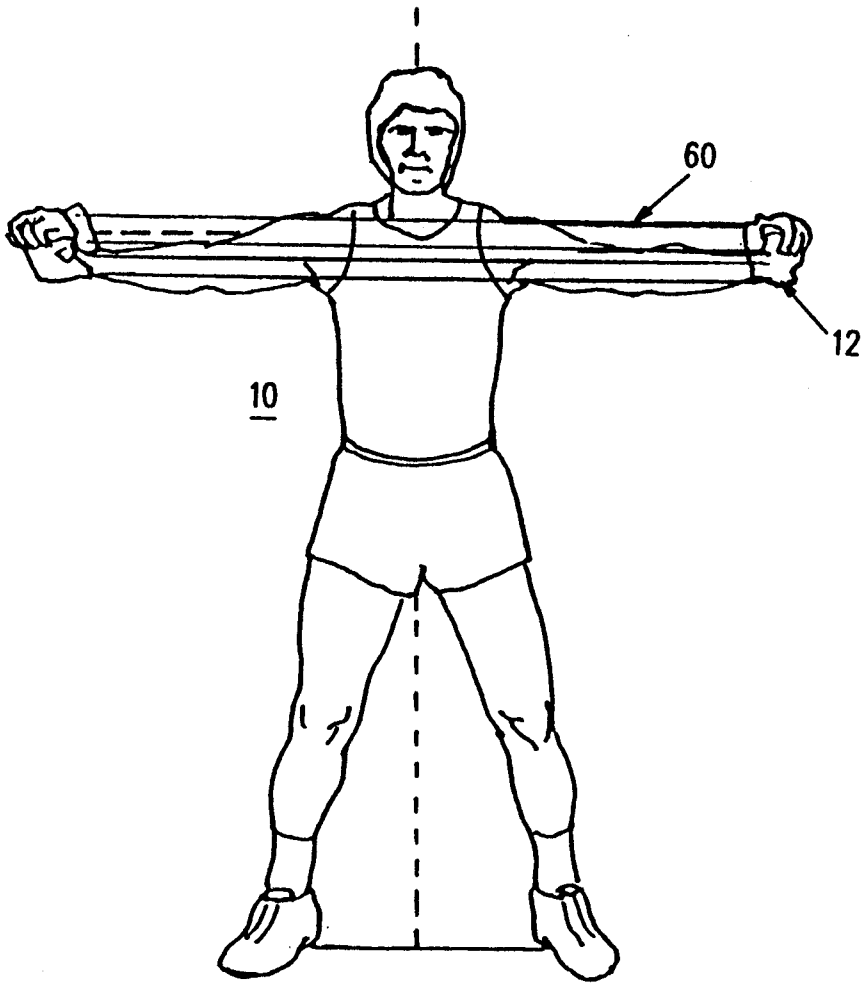
FIGS. 6A and 6B are perpective views of the exerciser in use for a bilateral front arm extension exercise.
Figure 6A:
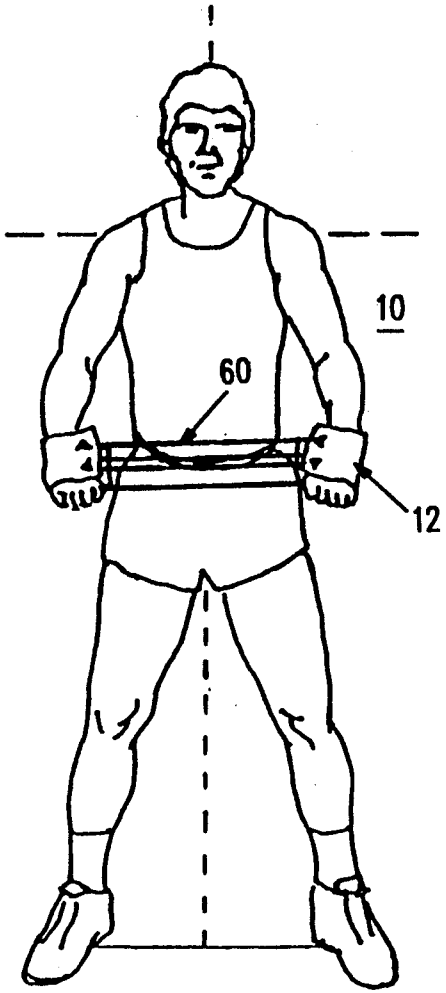

Referring now to FIG. 6, the use of exerciser 10 in a bilateral front arm extension exercise is shown. Standing with the feet shoulder width apart, exerciser 10 is positioned so that the user's hands grip the edges of the pads 12 and 20. Exerciser 10 is held at waist level with the elbows slightly bent. As the exerciser is extended and raised to shoulder level, the user exhales and pushes outward with the heels of the hands to the maximum point of resistance of flexible member 60 without pain. This position is held for one to two seconds before returning to the start position while the user inhales.

Figure 7B:
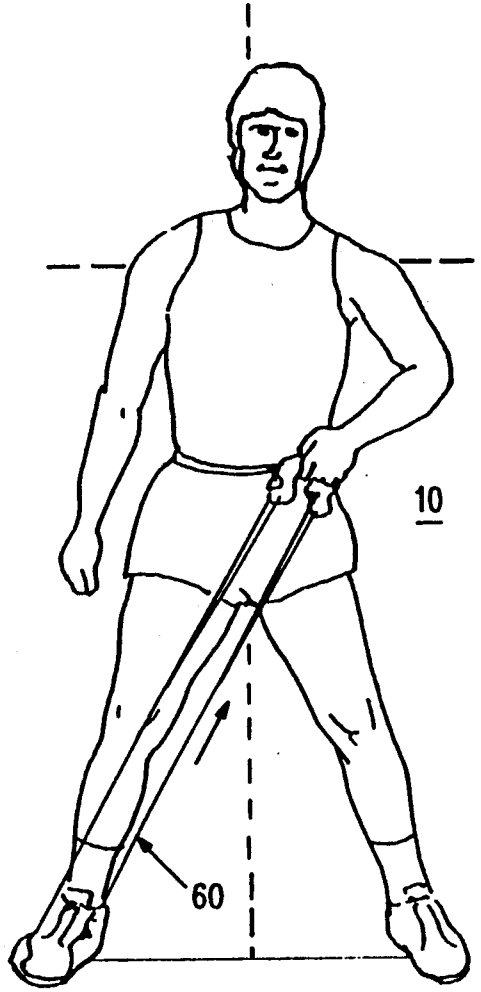
FIGS. 7A and 7B are perspective views of the exerciser in use for a standing cross-over row exercise.
Figure 7A:
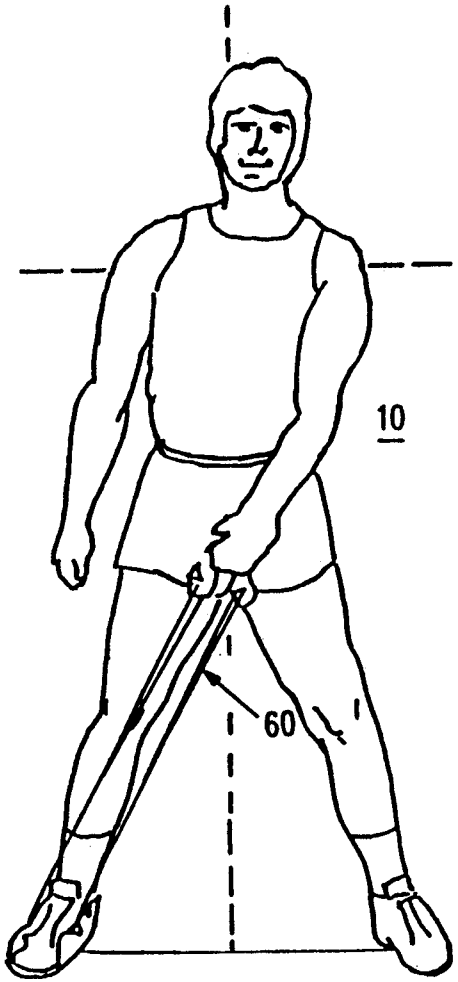

In FIG. 7, the use of exerciser 10 in a standing crossover row exercise is shown. Standing with the feet slightly farther apart than shoulder width, one end of exerciser 10 secured under the arch of the right foot. The other end of exerciser 10 is held in the left hand. Exhaling as the exerciser is pulled diagonally upward, the user tries to keep as straight a diagonal line as possible, until the maximum point of resistance of flexible member 60 is reached without pain. This position is held for one to two seconds. The user inhales as the device is returned to the start position.

Figure 8B:
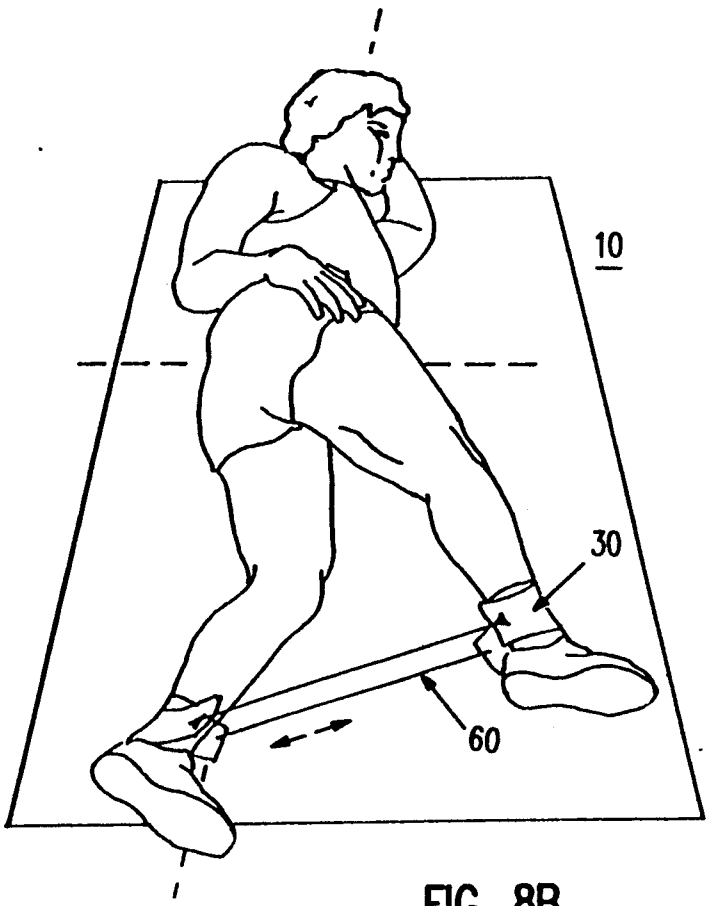
FIGS. 8A and 8B are perspective views of the exerciser in use for a leg scissor exercise.
Figure 8A:
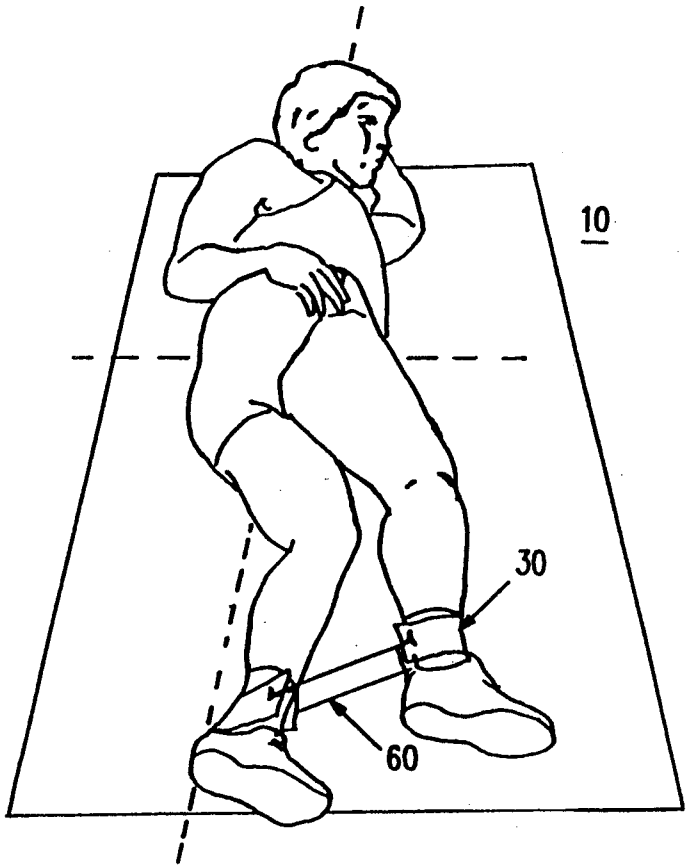

Referring finally to FIG. 8, the use of exerciser 10 in a leg scissor exercise is shown. The user lies down on the left side with the left arm bent at the elbow and the head resting on the left hand. Exerciser 10 is positioned at the ankles with the feet together. The user exhales as the right leg is slowly extended forward and the left leg backward in a scissor motion, keeping the knees slightly bent, until the maximum point of resistance is reached by the exerciser without pain. After holding for one to two seconds, the user inhales as the exerciser is slowly returned to the start position.

These are three of the possible exercises which can be performed with the present invention. Additional exercises for other muscle groups will be readily apparent to the user.

The function, use and adjustment of both configurations of the exerciser of the present invention are more fully described in Exhibit A hereto entitled "STRETCH & FLEX: A complete Fitness Program for Noticeable Results". The exerciser of the present invention provides eccentric, concentric and isometric, as well as vertical and horizontal exercise for nearly all muscles of the human body. Exhibit A forms a part of this specification.

The present invention has been particularly shown and described with respect to certain preferred embodiments thereof. However, it should be readily apparent to those of ordinary skill in the art that various changes and modifications in form and details may be made without departing from the spirit and scope of the invention as set forth in the appended claims.

I claim:

1. An exerciser comprising:

at least one generally rectangular flexible body pad, said body pad having apertures therethrough proximal each corner of said body pad;

at least one generally rectangular flexible cushioned hand pad, said hand pad being smaller than said body pad, and said hand pad having one dimension smaller than the other dimension and having an aperture therethrough proximal the center of each smaller dimension of said hand pad;

at least two longitudinally elastically resilient flexible members for coupling said body pad and said hand pad; and a plurality of knot-forming means for coupling each end of said longitudinally flexible members to said body pad and said hand pad, said longitudinally flexible members passing through said apertures in said body pad and said hand pad generally orthogonal to the plane of said pads, said knot-forming means comprises a flat plate having first, second and third apertures therethrough, said first apertures being proximal the center and second and third said apertures being proximal the periphery of said knot-forming means wherein the distance between said first aperture and said second and third apertures is less than the diameter of said apertures and the distance between said second and third apertures is greater than the diameter of said apertures.

2. An exerciser as in claim 1 wherein said longitudinally flexible member is latex surgical tubing.

3. An exerciser as in claim 1 wherein: said apertures are disposed in an isosceles triangle configuration having said first aperture at the peak of said isosceles triangle.

4. An exerciser as in claim 3 wherein the distance between said first aperture and said second and third apertures is approximately two-thirds the diameter of said apertures, and the distance between said second and third apertures 's approximately one and one-half times the diameter of said apertures.

5. An exerciser as in claim 1 further including:

a second body pad;

a second hand pad; and two additional longitudinally flexible members for coupling said second body pad and said second hand pad to said one body pad and one hand pad.

6. An exerciser as in claim 1 wherein said body and said hand pads may be used interchangeably.

7. Apparatus for performing isotonic exercises comprising:

at least two elastically longitudinally, elastically resilient, flexible members for developing resistive forces; and a plurality of cushioned generally rectangular pads, adjustably coupled to said stretchable members, for contacting a user's body, for receiving said resistive forces and for distributing said forces over areas of said user's body in contact therewith, the apparatus further including, apertures in said body pads proximal the periphery thereof, a knot-forming means for adjusting and securing the length of said stretchable member, wherein said knot forming means comprises a flat plate having first, second, and third apertures therethru, said first apertures being proximal the center, and second and third apertures being proximal the periphery of said knot-forming means, the distance between said first aperture and said second and third apertures being greater than the diameter of said apertures.

8. Apparatus as in claim 7 wherein said apertures being disposed in an isosceles triangle configuration having said first aperture at the peak of said isosceles triangle.

9. Apparatus as in claim 8 wherein the distance between said first aperture and said second and third apertures is approximately two-thirds the diameter of said apertures, and the distance between said second and third apertures is approximately one and one-half times the diameter of said apertures.

10. An exerciser as in claim 7 wherein said flat plate is formed of plastic material.

11. An exerciser as in claim 7 wherein said flat plate is formed of metal material.

* * * * *